US005643411A

United States Patent [19]

Ford

[11] Patent Number: 5,643,411

[45] Date of Patent: Jul. 1, 1997

[54] PROCESS FOR OPERATING A WOOD PULP DIGESTER SAMPLING DEVICE

[75] Inventor: Jerry C. Ford, Fernandina Beach, Fla.

[73] Assignee: Rayonier Inc., Stamford, Conn.

[21] Appl. No.: 302,533

[22] Filed: Sep. 8, 1994

Related U.S. Application Data

[62] Division of Ser. No. 960,483, Oct. 9, 1992, Pat. No. 5,366, 592.

[51] Int. Cl.[6] ..... D21C 7/12

[52] U.S. Cl. ..... 162/49; 162/198; 162/263; 73/863.86

[58] Field of Search ..... 162/49, 198, 263; 73/863.01, 863.11, 863.86

[56] References Cited

U.S. PATENT DOCUMENTS

| | | | |
|---|---|---|---|
| 2,746,297 | 8/1956 | Martin | 73/421 |
| 3,659,461 | 5/1972 | Thompson | 73/422 R |
| 4,341,124 | 7/1982 | Rodgers et al. | 73/863.01 |
| 4,540,468 | 9/1985 | Genco et al. | 162/49 |
| 5,154,087 | 10/1992 | Wenshau et al. | 73/863.85 |

OTHER PUBLICATIONS

Lavigne, John R., "An Introduction to Paper Industry Instrumentation", 1977, pp. 421–429.

Paulonis et al., "Kappa Numbers & Overall Yield Calc. Based on Digester Liquor Analysis", Nov. 1988 Tappi Journ., pp. 185–187.

*Primary Examiner*—Donald E. Czaja
*Assistant Examiner*—Dean T. Nguyen
*Attorney, Agent, or Firm*—Curtis, Morris & Safford, P.C.; William J. Spatz

[57] ABSTRACT

A sampling device for a batch or continuous pulp digester for reduction of pulp sampling errors such as during a digester "blow" and for improving a pulping process based on the obtained samples.

22 Claims, 5 Drawing Sheets

| STEP | 19 | 20 | 21 | 22 | PURPOSE |
|---|---|---|---|---|---|
| 1 | OPEN | CLOSED | OPEN | OPEN | CLEAR VALVE C TO DIGESTER |
| 2 | OPEN | OPEN | OPEN | CLOSED | TAKE SAMPLE |
| 3 | OPEN | CLOSED | OPEN | OPEN | CLEAR VALVE C TO DIGESTER |
| 4 | OPEN | OPEN | CLOSED | OPEN | CLEAR VALVE B TO SAMPLER |
| 5 | CLOSED | CLOSED | CLOSED | CLOSED | SEQUENCE COMPLETE |

| STEP | 19 | 20 | 21 | 22 | PURPOSE |
|---|---|---|---|---|---|
| 1 | OPEN | CLOSED | OPEN | OPEN | CLEAR VALVE C TO DIGESTER |
| 2 | OPEN | OPEN | OPEN | CLOSED | TAKE SAMPLE |
| 3 | OPEN | CLOSED | OPEN | OPEN | CLEAR VALVE C TO DIGESTER |
| 4 | OPEN | OPEN | CLOSED | OPEN | CLEAR VALVE B TO SAMPLER |
| 5 | CLOSED | CLOSED | CLOSED | CLOSED | SEQUENCE COMPLETE |

PROCESS FOR OPERATING A WOOD PULP DIGESTER SAMPLING DEVICE

This application is a division of application Ser. No. 07/960,483, filed Oct. 9, 1992, now U.S. Pat. No. 5,366,592.

This invention relates to wood pulping, more specifically, this invention relates to a process for controlling the quality of wood pulp by an improved operation of a wood pulp digester; more particularly, this invention relates to a wood pulp digester sampling device and a method for operating a sampling device. Still further this invention relates to a method for removing variability in wood pulp sampling process during a wood pulp digester blow.

BACKGROUND FOR INVENTION

When operating a wood pulp digester it is important to know the various factors for the control of the wood chip cooking process. Such control is necessary to adjust the digester cooking conditions based on the test results which have been obtained from a previous batch. Thus, in a feedback manner, the tests which have been obtained from a previous batch of wood pulp during a discharge or a "blow" of the wood pulp from a digester are then used to adjust the next batch. Typically, representative samples for laboratory testing are obtained during the discharge cycle of a digester known as a "digester blow". A digester blow lasts about 10 to 15 minutes, typically 12 to 14 minutes and a sample is typically obtained at about 2 minutes from start of a blow at an interval from about 1 minute to about 5 minutes. A typical sample gathering cycle is about 2 minutes throughout the digester blow cycle.

When the samples are conventionally obtained, these show a large variability between the various samples taken at different times from the same digester blow. Replicate testing however on the same sample indicates that the variability of the testing itself is quite small.

It is also known that large industrial digesters digest wood pulp in an inhomogenous manner throughout the chip mass. Infrequent sampling or a single sample obtained during the digester blow cycle represent only a small portion of the batch. Typically, it has been sought to minimize the unrepresentative sampling by taking a composite multiple grab sample over equal increments of time while the batch is being discharged from the digester vessel i.e. during a digester blow. However, unreliable readings are introduced since individuals introduce unacceptable variations in the procedure by their own sampling techniques. Moreover, as the act of sampling itself causes unwanted expelling of gases and hot digester liquor, i.e. digester effluents, the hazards are now ameliorated or minimized in a mill operation employing the novel sampling device.

PRIOR ART

The prior art known to the inventor is that found in a typical mill application. A sampling is performed in a prescribed manner by manually operating i.e., opening and shutting a valve such as a valve appropriately located near the bottom of the digester. A wood pulp fiber sample is selected from a sample blown against a target during the sampling cycle. Typically, targets are fixed metal plates which contribute to the disintegration of the cooked wood chips. Conventionally, four samples are sought to be taken during the digestive blow and a composite formed to obtain a representative sample for analysis.

Inasmuch as individual's own sampling procedure introduces variables, uncontrolled variations in the sampling process occur. Thus, gross adjustments to a wood pulping process are often based on erroneous sampling results. Results occur that have gross degrees of variation in the next batch of wood chips being subjected to digestion. Subsequent digester operation thus result in fairly wide swings in pulp properties from the uncontrolled variations in the sampling process or produce randomly uncontrolled variations in the digestion process itself.

In other mills, representative samples have been sought from a single sample obtained from the blow pit or blow tank. In tests conducted on samples obtained from a blow pit, these tests did not provide a predictable, representative sample of the average of the samples taken from the digester during the blow.

BRIEF DESCRIPTION OF THE INVENTION

In accordance to the invention, it has been found that if properly obtained pulp samples are secured from a wood pulp digester during the digester blow, then improved sampling and testing provide means for operating a wood pulp digester in a more predictable, advantageous, and improved manner. Further, a novel sampling device operated in conjunction with a wood chip digester provides improved sample selection. An improved method for sampling has resulted in a reduction in the variability of wood pulp samples obtained during a digester blow. Thus an improved method for wood pulp digester blow sampling has now been found to be advantageous for improving pulp quatity. Still further a method for operating a sampling device in a given sequence has provided improved sampling results. These and other advantages of the present invention will now be further described.

DETAILED DESCRIPTION OF THE DRAWINGS AND THE EMBODIMENTS OF THE PRESENT INVENTION

With reference to the drawings illustrating the present invention and the various embodiments thereof:

Figure 1:
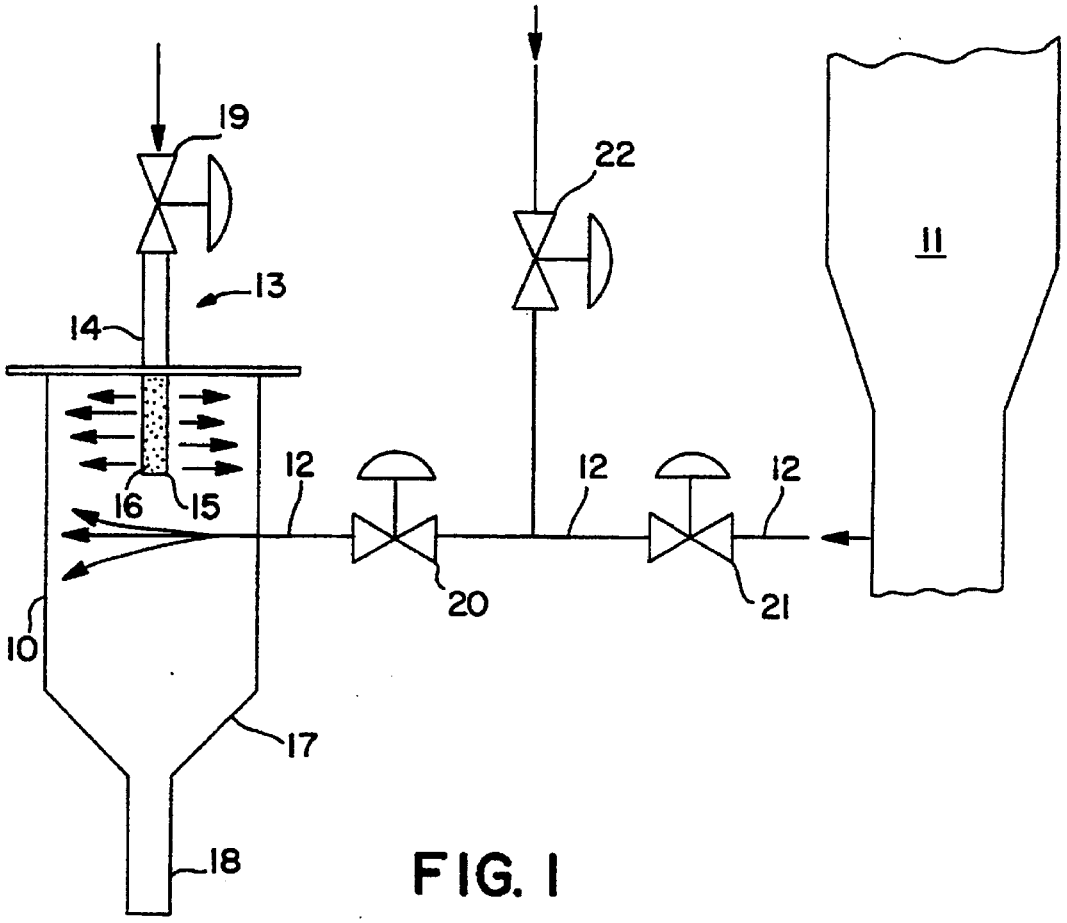
FIG. 1 shows a schematic arrangement of a sampling device in combination with a digester.

As shown in FIG. 1, the sampling device flash vessel 10 is used in combination with a digester 11. The volume of a flash vessel is about 6,500 cubic inches but may be larger or smaller. The flash vessel 10 has a pipe 12 by which the pulp sample is blown from the digester 11 via pipe 12 into the flash vessel 10. Typical operating conditions for a digester are: pressure of about 100 psig; temperature (upper or maximum) is dependant on the grade of pulp being produced but ranges from about 130° C. to about 150° C. A quench medium, i.e. water spray injection means 13 is fixed on the top of the vessel 10 to condense the vapors evolving from the flashing blow sample and to wash the pulp fibers down the walls of the vessel 10. For the above vessel quench water flow is about 30 gallons per minute, but the amount may be varied to suit the conditions. The injection means 13 is in form of a pipe 14, having at the end thereof a spray head 15 which contains a number of holes 16 for discharging water injected into flash vessel 10. A conical bottom 17 is provided for flash vessel 10. A discharge pipe 18 leads from the vessel 10 to a sample catch device in the form of a wire basket 23. The operation of valves 19, 20, 21, and 22 will be described in conjunction with the predetermined sampling sequence described in FIG. 8 herein.

Figure 2:
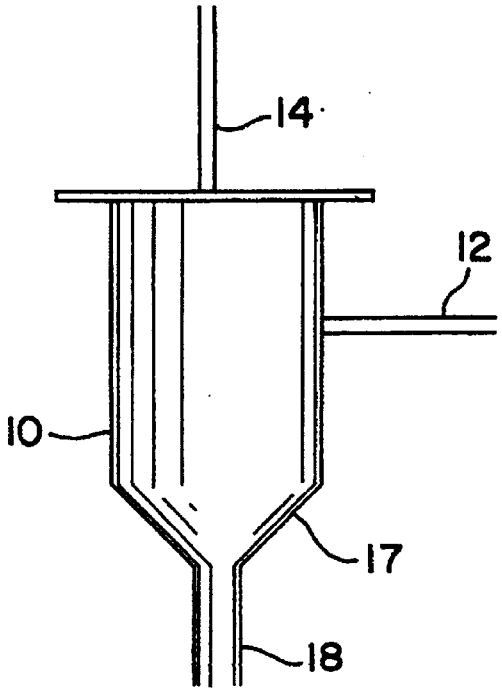
FIG. 2 shows a side elevation of a digester sample flash vessel schematically illustrated in FIG. 1.
Figure 3:
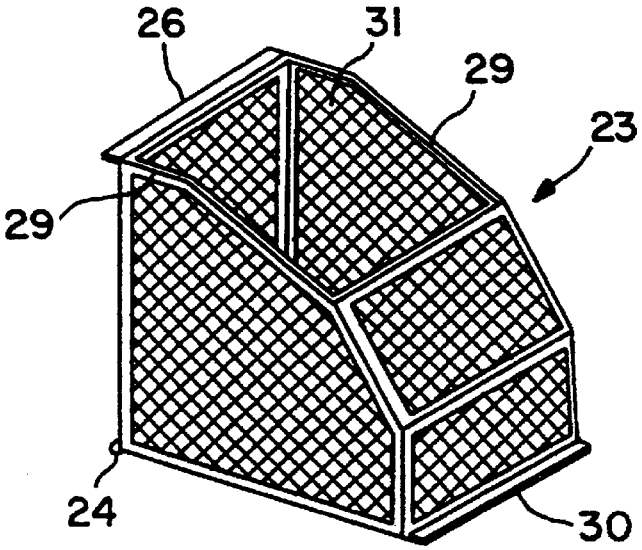
FIG. 3 shows a pulp sample wire basket used in combination with digester sample flash vessel shown in FIG. 2.
Figure 4:
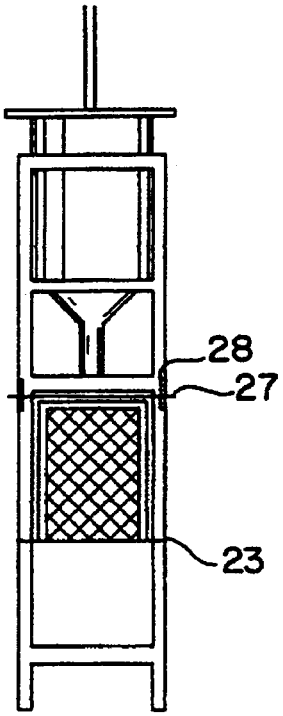
FIG. 4 illustrates a front elevation of the combination of the flash vessel and sample wire basket.
Figure 5:
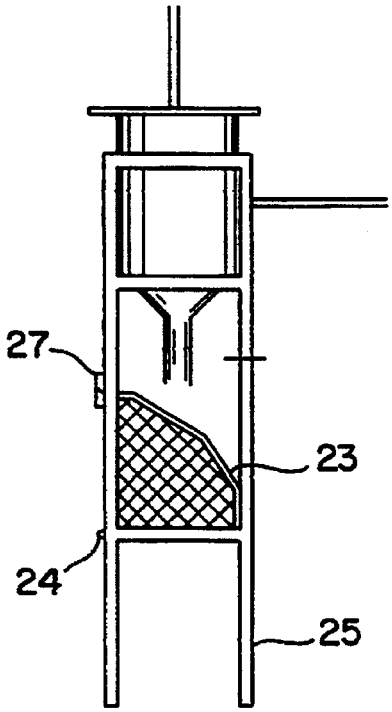
FIG. 5 shows a side elevation of the flash vessel and sample basket shown in FIG. 4.
Figure 6:
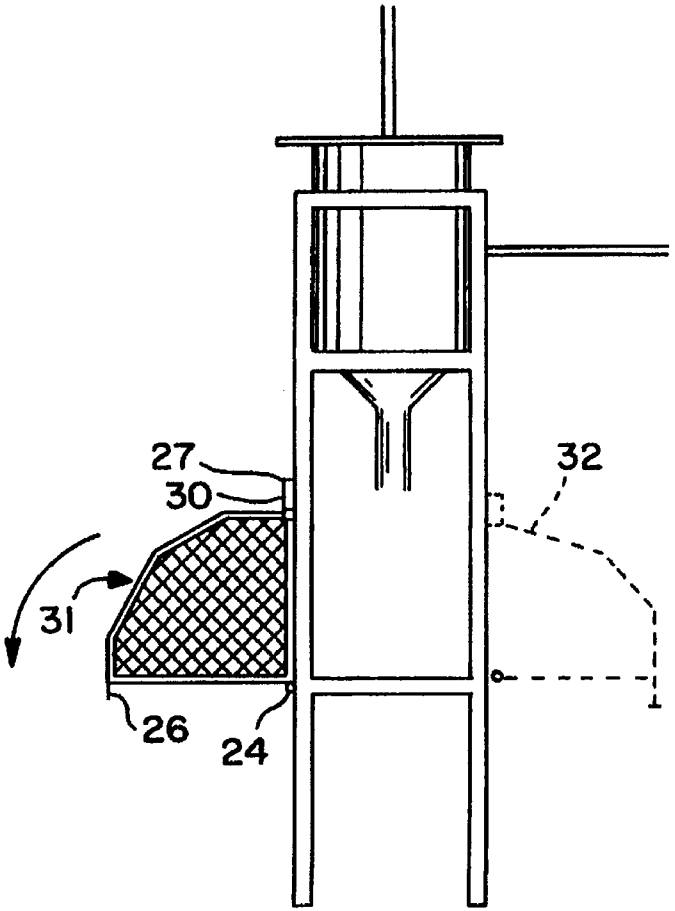
FIG. 6 shows a side elevation shown in FIG. 5 with a basket in position for blending and gathering a sample.

A fiber sample is collected in the wire basket 23 positioned under the discharge pipe 18 as shown in FIGS. 2 and 3. The wire basket 23 has a pivot shaft 24 shown in FIGS. 3 to 7. The wire basket 23 is pivotable out of the sampler frame 25 by pulling on the upper handle 26 and held in place by a latching bar 27. The spring loaded latching bar 27 is attached on both sides of the front of the frame 25 by two D-brackets 28. The latching bar rides over the top rails 29 of the wire basket 23 as it is pivoted out of the frame 25. After the wire basket 23 has rotated about 90 degrees, the bottom handle 30, on the bottom rear of the wire basket 23, is blocked by and held in place by the latching bar 27 as shown in FIG. 6.

Figure 7:
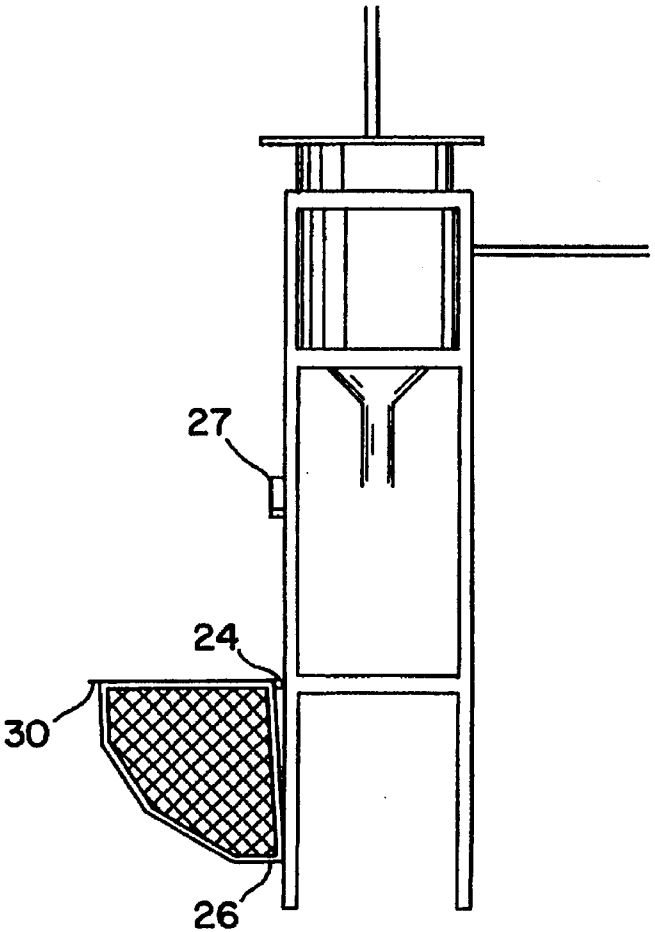
FIG. 7 shows the device in FIG. 5 in a further sample discharge position during the operating cycle.

The wire basket 23 is held in this position while a technician obtains a fiber sample through the wire basket opening 31. When a technician lifts the latching bar to release the rear handle 30, the basket pivots into an inverted position discharging the excess material as shown in FIG. 7. After cleaning, the wire basket 23, is returned to its ready position inside the frame 25. The pivot shaft 24 may also be latched (not shown) to allow complete removal of wire basket 23.

While in FIGS. 4 to 7 only one wire basket 23 has been shown, it is possible to mount up to four wire baskets 23 in the square frame 25. A second wire basket 32 has been shown in phantom lines to illustrate this embodiment. Likewise, more than one flash vessel 10 and the required, accompanying devices may be coupled to a digester 11 to allow multiple sample obtention in a facile and quick succession.

Accordingly, if the wire basket 23 and 32 are operated automatically such as e.g. by a pneumatic cylinder means (not shown) to place in position for sampling and to remove wire basket 23 after a sample has been obtained (including pneumatically driven latching means), a sampling sequence may take place without a technician's assistance during a sampling and each sample may be taken away after a digester blow has been completed. As an added benefit, the entire sampling device i.e., flash vessel 10 and wire baskets 23 and 32 with the necessary frame 25, may be housed in an enclosure (not shown) which prevents any significant amount of digester blow gases, i.e. digester effluent from escaping into the environment, e.g., the entire enclosure may be appropriately evacuated such as by vacuum means (not shown) and then sent to a scrubber (not shown).

Figure 8:
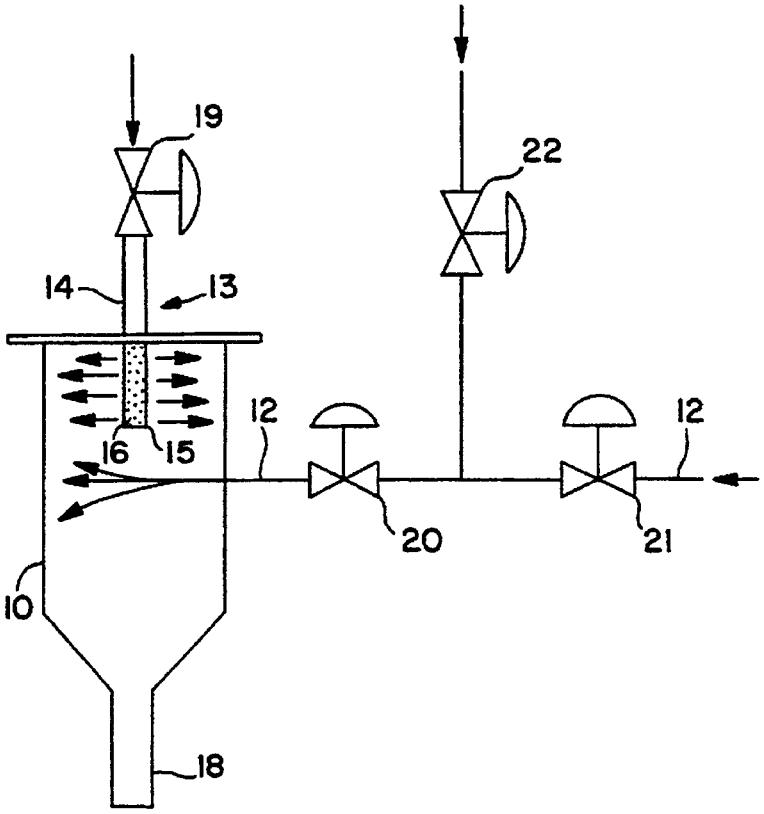
FIG. 8 illustrates the schematic arrangement of valves shown in FIG. 1 in conjunction with a table showing the sequencing of the automatic valves for obtaining a proper pulp sample from a blow pit or pot during a digester blow cycle.

A significant benefit has been found to be the automation of the valves shown in the schematic in FIGS. 1 and 8 including the sequencing shown in the table for FIG. 8. The initial step in the sample sequence is the opening of the quench water valve 19; in this embodiment, the valve is a 1½ inch electrically operated ball valve. As mentioned before, the amount of quench water may be varied but is about 30 gallons per minute. Next the steam valve 22, which in this illustration is a one inch pneumatically operated ball valve, and the digester blow line valve 21 are opened and the sample line 12 is cleared back into the digester 11. The sample valves in this illustration are also one inch pneumatically operated ball valves. Then the steam valve 22 is closed, the sample valve 20 opened for the one second, and a pulp sample, because of the pressure in the digester, is passed from the digester 11 to the flash vessel 10 via pipe 12. To complete the cycle, the fibers remaining in the sample pipe 12 are blown alternatively back into the digester 11 or to the flash vessel 10, when the steam valve 22 is opened and either valve 21 is opened or it is closed and valve 20 is opened. Conditions in the steam line are illustrative only and are as follows 150 psig steam with approximately 100° F. of super heat for a typical temperature of about 450° F. The above conditions, of course, may be varied and are typically varied and therefore are intended for purposes of illustration only.

The sampling sequence is repeated for as many times as necessary to obtain a representative pulp sample for subsequent analysis; or each sample may be analyzed for statistically controlling the pulping process. As an example, the first sample is taken two minutes after the beginning of the digester blow for three to five times total (typically five times) at two minute intervals after the first sample is taken. The sampling process maybe established by an appropriate schedule as designed for a particular digester or as formed by experience. The sampling device may also be purged by steam via valve 22 and the quench medium via valve 19 by opening valve 20.

A flashing light (not shown) over the sampling device may be provided while the sampling sequence is in progress. The light burns steadily when the sequence is complete to tell the technician which digester has blown and requires a sample to be taken. A switch (not shown) mounted to the front of the sample frame may be provided to electrically disconnect the sample valve 20 and keep it in a closed position thereby preventing an accidental exposure to hot materials.

The major variables that are controlled in a pulping process are the average degree of polymerization or molecular weight of the cellulose molecules as measured by the intrinsic viscosity test and the amount of residual lignin remaining in the fibers as measured by the K-Number or Kappa Number tests. Typically a grade of wood pulp will have in process specification targets and limits for these two variables. Testing for these properties is typically performed on every batch, or at fixed time intervals for continuous processes, and the results of the laboratory analyses are used to adjust the process variables of digesters in progress. The major process variables in digestion of wood chips by the acid sulfite process include:

1. The strength of the cooking acid both true free and combined sulfur dioxide.
2. The maximum temperature of the batch.
3. The elapsed time to achieve the maximum temperature.
4. The elapsed time at the maximum temperature.
5. The elapsed time for the step of relieving the pressure from the digester.

For batch digesters in progress, the main process variables which are adjusted based on the laboratory test results are the elapsed time at the maximum temperature and the elapsed time for relieving the digester pressure. For continuous digesters both the maximum temperature and the strength of the cooking acid can be adjusted based on the laboratory results.

The herein disclosed sampling system has been used to obtain more representative digester samples. The more reliable test information attained has provided the basis for reducing the variability of these important parameters. The. standard deviation of the Cook Intrinsic Viscosity test has been reduced to 0.409 compared to 0.431 for the period prior to the installation of the sampling devices. Similarly the standard deviation of the Cook K-Number test has been reduced to 1.95 compared to 2.24 for the period prior to the samplers. The reduction in both of these parameters has resulted in significant improvements in the ease and cost of the down stream processing steps. This has improved both the quality of the final product and cost of the final product. In accordance with the pulp and paper industry practices, tests for the above variables, are the conventionally employed TAPPI methods of analyses.

To sum up, the removal of the sources of variability in cooking as obtained from rigorous sampling and analysis ultimately leads to less variability in the final product with resultant greater acceptance of the higher quality pulp in the market place. By the described combination the effects of sampling variability have been reduced and better pulp quality has been achieved. Further, safety for operating personnel is given more consideration and the environmental disadvantages due to sampling are abated by the reduction and/or containment of the digester effluent. With the previous manual technique, the mixture of stream and sulfur dioxide gas, as it flashed from the sample, were deleterious and required a technician to wear suitable gear. The deleterious gases are now quenched in the novel device and, in fact, for a described embodiment a technician does not have to be present for the actual sampling.

Various and other benefits should be readily evident from the description of the invention and the various embodiments thereof. These are not intended to limit the invention which is defined by claims which follow.

I claim:

1. A process for pulping wood in a digester wherein control of the digester cooking process is desired by sampling and analyzing samples of wood pulp and adjusting the digester conditions based on the analysis of the wood pulp samples, comprising:

(a) automatically and systematically sampling cooked wood pulp a plurality of times from a discharge stream of the digester thereby securing a plurality of samples free from manually introduced sampler variability using a sampling operation as shown in FIG. 8 comprising the sequential steps of:

(i) opening valve means 21 and steam valve means 22 while valve means 20 is closed to clear the sampling lines to digester with steam;

(ii) opening valve means 20 and closing steam valve means 22 to take sample from digester;

(iii) closing valve means 20 and opening steam valve means 22 to clear sampling line to digester;

(iv) opening valve means 20 and closing valve means 21 to clear sampling line to sampling vessel; and (v) closing valve means 20 and steam valve means 22 to complete the sampling sequence;

(b) obtaining at least one composite sample which is representative of the wood pulp from said digester by combining said plurality of samples free from manually introduced sampler variability;

(c) analyzing said composite sample for pulp properties necessary for digester control; and (d) adjusting the digester for process conditions based on results obtained from an analysis of said composite sample of digester wood pulp, wherein said sampling of said cooked wood pulp is achieved with a wood pulp sampling device comprising:

a conduit from the digester;

an array of valve means comprised of individual valve means on said conduit;

a flash vessel means interconnected via said conduit with said digester comprising an outlet means and a quench means; and means for catching said samples of wood pulp from said outlet for said flash vessel means.

2. The method for pulping wood in a digester as defined in claim 1, wherein the digester is a batch digester.

3. The method for pulping wood in a digester as defined in claim 1, wherein the digester is a continuous digester.

4. The method as defined in claim 1 wherein the digester is a batch digester and wherein the process control variables which are analyzed are at least one of the following variables: molecular weight of cellulose, amount of residual lignin in cellulose, strength of cooking acid, pressure relief schedules for digester, maximum temperature during cooking, elapsed time to achieve maximum temperature; or elapsed time at maximum temperature during a cook.

5. The process of claim 1, wherein sampling of cooked wood pulp is achieved with a wood pulp sampling device comprising:

a conduit from the digester;

an array of valve means comprised of individual valve means on said conduit;

a flash vessel means interconnected via said conduit with said digester comprising an outlet means and a quench means;

said quench means for said flash vessel means comprising a quench medium conduit, a quench medium injecting means for injecting a quench medium into said flash vessel means, and a quench medium valve means;

said array of valve means of individual valve means and quench medium valve means interconnected with said digester and said flash vessel means, said individual valve means capable of being sequentially operable; and means for catching a sample of wood pulp from said outlet for said flash vessel means.

6. The method as defined in claim 5, and wherein said flash vessel is first purged with a quenching medium of water and then is purged with steam.

7. The process of claim 5, wherein the array of valve means further comprises a valve control means for operating the individual valve means for clearing said conduit from said digester, for opening and closing said conduit from said digester, and for opening and closing said conduit for ingress of the pulp sample from said digester into the flash vessel means.

8. The process of claim 5, wherein the means for catching a sample of wood pulp is rotatably mounted to said outlet.

9. The process of claim 8, wherein the means for catching a sample of wood pulp further includes a sample catch control means for automatically catching said sample from said outlet.

10. The process of claim 5, wherein the digester is a continuous digester.

11. The process of claim 5, wherein the digester is a batch digester.

12. The process of claim 5, wherein said wood pulping device further comprises a containment means for said sampling device for containment of volatile digester effluents.

13. The process of claim 5, wherein the array of valve means includes a first, second and third valve means and a valve control means for activating the first, second and third valve means which also activates the quench medium valve means in conjunction with the first, second and third valve means.

14. A process for pulping wood in a digester in a digester wherein control of the digester cooking process is desired by sampling and analyzing samples of wood pulp and adjusting the digester conditions based on the analysis of the wood pulp samples, comprising the steps of:

(a) automatically obtaining a representative pulp sample substantially variability free from a load of wood chips being cooked in a digester for analysis of said pulp using a sampling operation as shown in FIG. 8 comprising the sequential steps of:

(i) opening valve means 21 and steam valve means 22 while valve means 20 is closed to clear the sampling lines to digester with steam;

(ii) opening valve means 20 and closing steam valve means 22 to take sample from digester;

(iii) closing valve means 20 and opening steam valve means 22 to clear sampling line to digester;

(iv) opening valve means 20 and closing valve means 21 to clear sampling line to sampling vessel; and (v) closing valve means 20 and steam valve means 22 to complete the sampling sequence;

(b) analyzing said representative pulp sample for properties necessary for digester control;

(c) adjusting said load of wood chips being pulped in said digester based on analyzed properties; and (d) thereby obtaining a wood pulp substantially free from sample variability affected properties.

15. The process of claim 14, wherein obtaining a representative pulp sample is achieved with a wood pulp sampling device comprising:

a conduit from the digester;

an array of valve means comprised of individual valve means on said conduit;

a flash vessel means interconnected via said conduit with said digester comprising an outlet means and a quench means;

said quench means for said flash vessel means comprising a quench medium conduit, a quench medium injecting means for injecting a quench medium into said flash vessel means, and a quench medium valve means;

said array of valve means of individual valve means and quench medium valve means interconnected with said digester and said flash vessel means, said individual valve means capable of being sequentially operable; and means for catching a sample of wood pulp from said outlet for said flash vessel means.

16. The process of claim 15, wherein the array of valve means further comprises a valve control means for operating the individual valve means for clearing said conduit from said digester, for opening and closing said conduit from said digester, and for opening and closing said conduit for ingress of the pulp sample from said digester into the flash vessel means.

17. The process of claim 15, wherein the means for catching a sample of wood pulp is rotatably mounted to said outlet.

18. The process of claim 17, wherein the means for catching a sample of wood pulp further includes a sample catch control means for automatically catching said sample from said outlet.

19. The process of claim 15, wherein the digester is a continuous digester.

20. The process of claim 15, wherein the digester is a batch digester.

21. The process of claim 15, wherein said wood pulping device further comprises a containment means for said sampling device for containment of volatile digester effluents.

22. The process of claim 15, wherein the array of valve means includes a first, second and third valve means and a valve control means for activating the first, second and third valve means which also activates the quench medium valve means in conjunction with the first, second and third valve means.

* * * * *